US006363157B1

(12) United States Patent
Chick

(10) Patent No.: US 6,363,157 B1
(45) Date of Patent: Mar. 26, 2002

(54) MULTIPLE ELEMENT ELECTROACOUSTIC TRANSDUCING

(75) Inventor: Geoffrey C. Chick, Norfolk, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 08/919,343

(22) Filed: Aug. 28, 1997

(51) Int. Cl.[7] ..... H04R 1/02
(52) U.S. Cl. ..... 381/89; 381/99
(58) Field of Search ..... 381/89, 337, 338, 381/339, 345, 346, 347, 348, 349, 99, 98; 181/141–147, 199

(56) References Cited

U.S. PATENT DOCUMENTS

| | | | | |
|---|---|---|---|---|
| 4,008,374 A | | 2/1977 | Tiefenbrum | 179/1 |
| 4,624,337 A | * | 11/1986 | Shavers | 381/89 |
| 4,628,528 A | | 12/1986 | Bose et al. | 381/90 |
| 4,783,820 A | * | 11/1988 | Lyngdorf et al. | 381/89 |
| 5,109,416 A | * | 4/1992 | Croft | 381/304 |
| 5,374,124 A | * | 12/1994 | Edwards | 381/351 |
| 5,537,479 A | * | 7/1996 | Kreisel et al. | 381/96 |
| 5,784,468 A | * | 7/1998 | Klayman | 381/300 |
| 5,815,589 A | * | 9/1998 | Wainwright et al. | 381/353 |

FOREIGN PATENT DOCUMENTS

| | | | |
|---|---|---|---|
| FR | 2505-125 | * 11/1982 | 381/89 |

* cited by examiner

*Primary Examiner*—Xu Mei
(74) *Attorney, Agent, or Firm*—Fish & Richardson P.C.

(57) ABSTRACT

A loudspeaker system includes an enclosure supporting first and second loudspeaker driver assemblies and having an internal volume. At least the first loudspeaker driver assembly is constructed and arranged to radiate sound energy into the listening region outside the enclosure over at least the range of audio frequencies above a predetermined first frequency. The second loudspeaker driver assembly is constructed and arranged to radiate sound energy over a first predetermined range of audio frequencies embracing at least a range of audio frequencies below a second frequency above the first frequency. The first loudspeaker driver assembly, the second loudspeaker driver assembly and the enclosure are constructed and arranged to coact to maintain the pressure in the enclosure substantially constant over at least the range of frequencies between the first and second frequencies.

24 Claims, 6 Drawing Sheets

MULTIPLE ELEMENT ELECTROACOUSTIC TRANSDUCING

The invention relates to multiple element electroacoustic transducing.

For background reference is made to U.S. Pat. No. 4,008,374.

It is an important object of the invention to provide an improved multiple element electroacoustic transducer.

According to the invention, there is an enclosure supporting a first loudspeaker driver assembly and a second loudspeaker driver assembly and having an internal volume. At least the first loudspeaker driver assembly is constructed and arranged to radiate sound energy into the listening region outside the enclosure over a first range of audio frequencies above a predetermined first frequency and a predetermined second frequency higher than the first frequency. The second loudspeaker driver assembly is constructed and arranged to radiate sound energy over a first predetermined range of audio frequencies embracing at least the range of audio frequencies between the first frequency and the second frequency. The first loudspeaker driver assembly, the second loudspeaker driver assembly and the enclosure are constructed and arranged to coact to maintain the pressure in the enclosure substantially constant over at least the range of frequencies between the first and second frequencies. The first predetermined range of audio frequencies may be substantially the full audio frequency range, or may correspond substantially to the bass frequency range. There may be an audio signal input and a low-pass filter coupling the audio signal input to the second loudspeaker driver assembly, and a high-pass filter coupling the audio signal input to the first loudspeaker driver assembly. The first loudspeaker driver assembly may comprise a number of loudspeaker drivers. There may be an audio signal input including a plurality of input channels coupled to respective ones of the loudspeaker drivers, and a summer coupling the input channels to the second loudspeaker driver assembly. The enclosure may include first and second ports coupling the first and second loudspeaker driver assembly to the listening region outside the enclosure.

The second loudspeaker driver assembly may be constructed and arranged to radiate to the listening region outside the enclosure through an acoustic impedance, such as an acoustic waveguide or port, or be coupled to an enclosed chamber.

In a specific form of the invention, the acoustic impedance may be an acoustic waveguide having one end closed and the other end open. In a specific form, the second loudspeaker driver assembly may be mounted such that the distance from the loudspeaker assembly to the open end is about twice the distance to the closed end. In another specific form, the acoustic impedance may be a ported or unported chamber.

According to a specific form of the invention the first loudspeaker assembly may have more loudspeaker drivers than the second loudspeaker assembly, and both assemblies may be limited to operating over the same bass frequency range.

Other features, objects and advantages will become apparent from the following detailed description which refers to the following drawings in which.

Figure 3A:
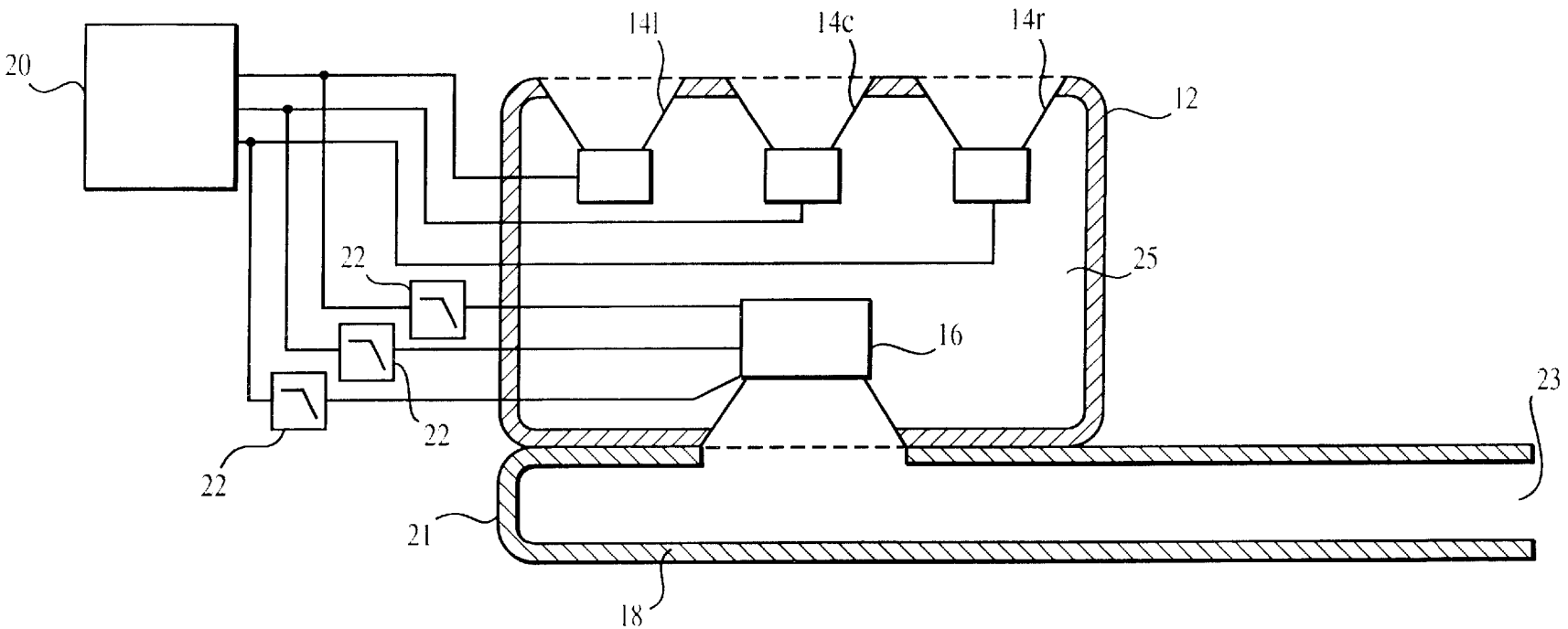
Figure 3B:
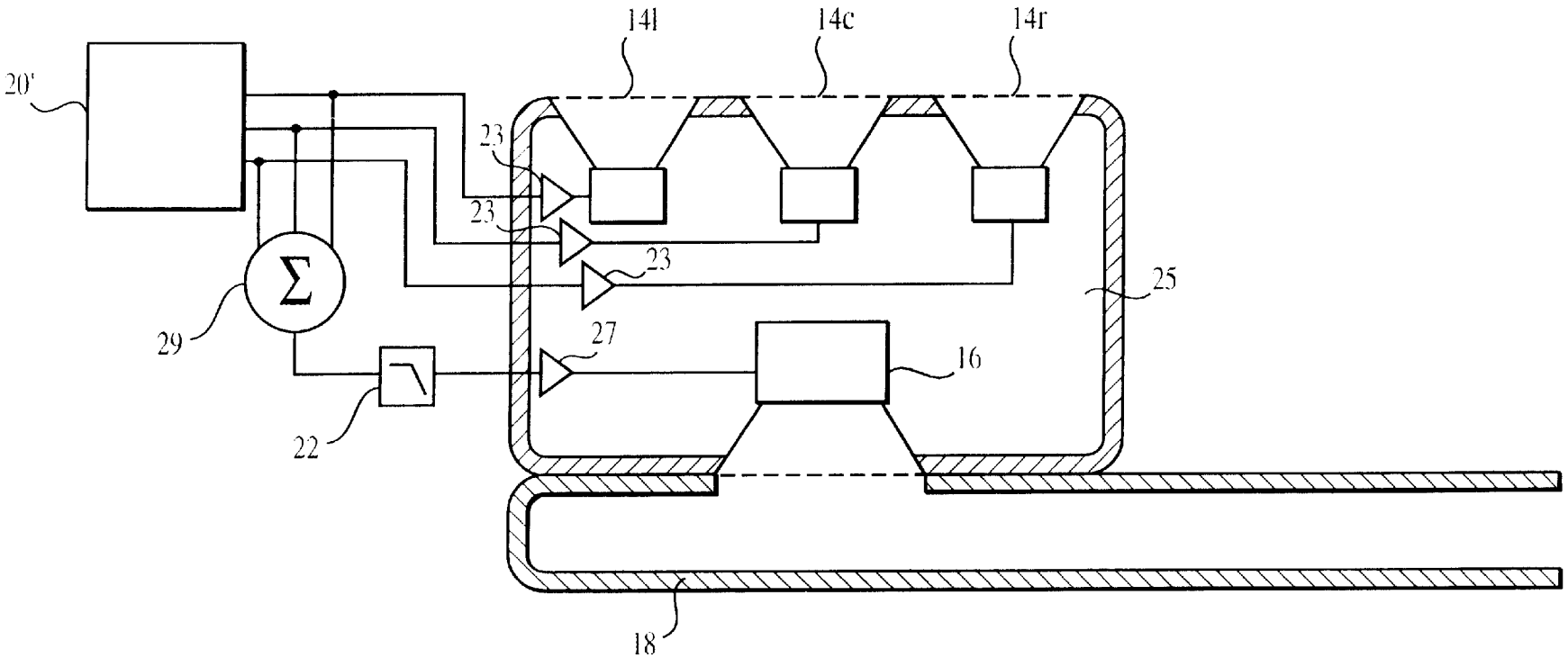
Figure 4:
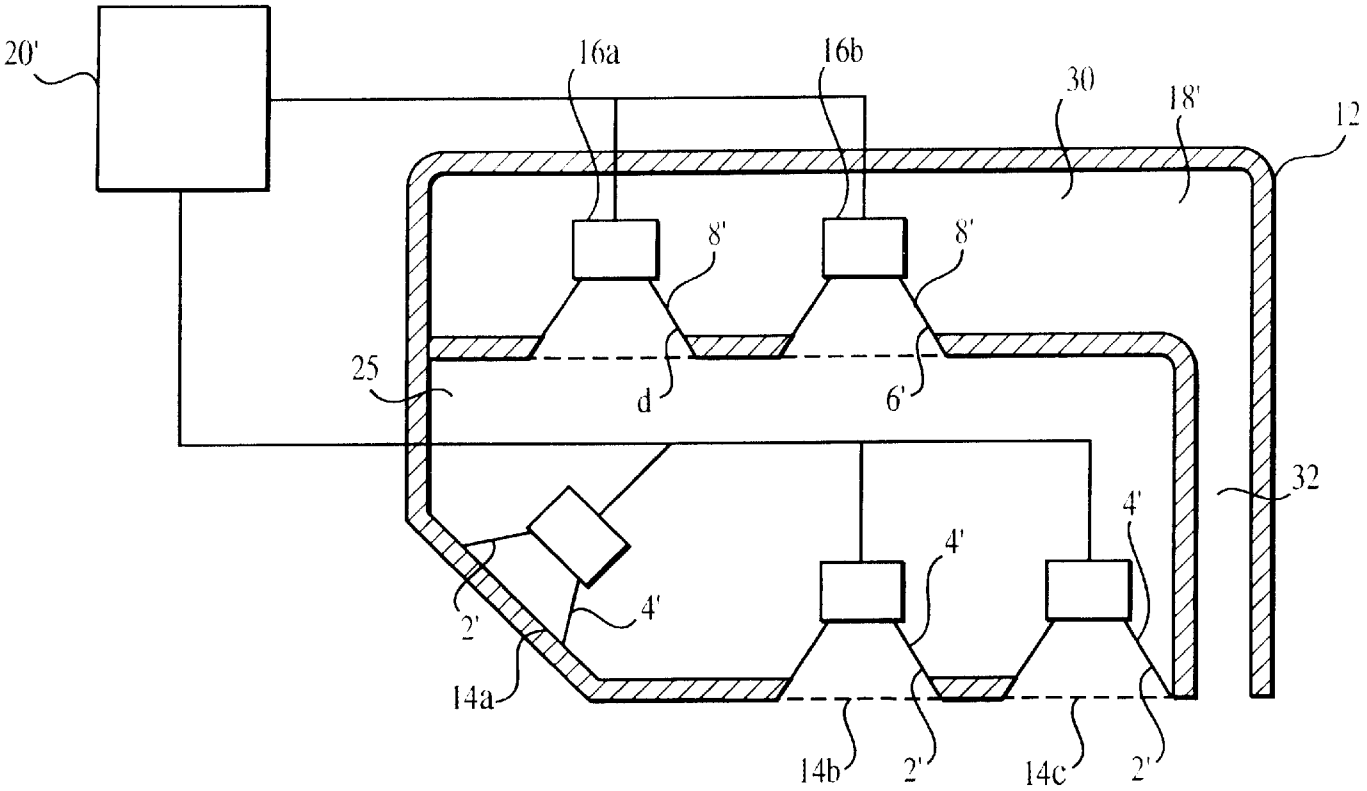
Figure 5:
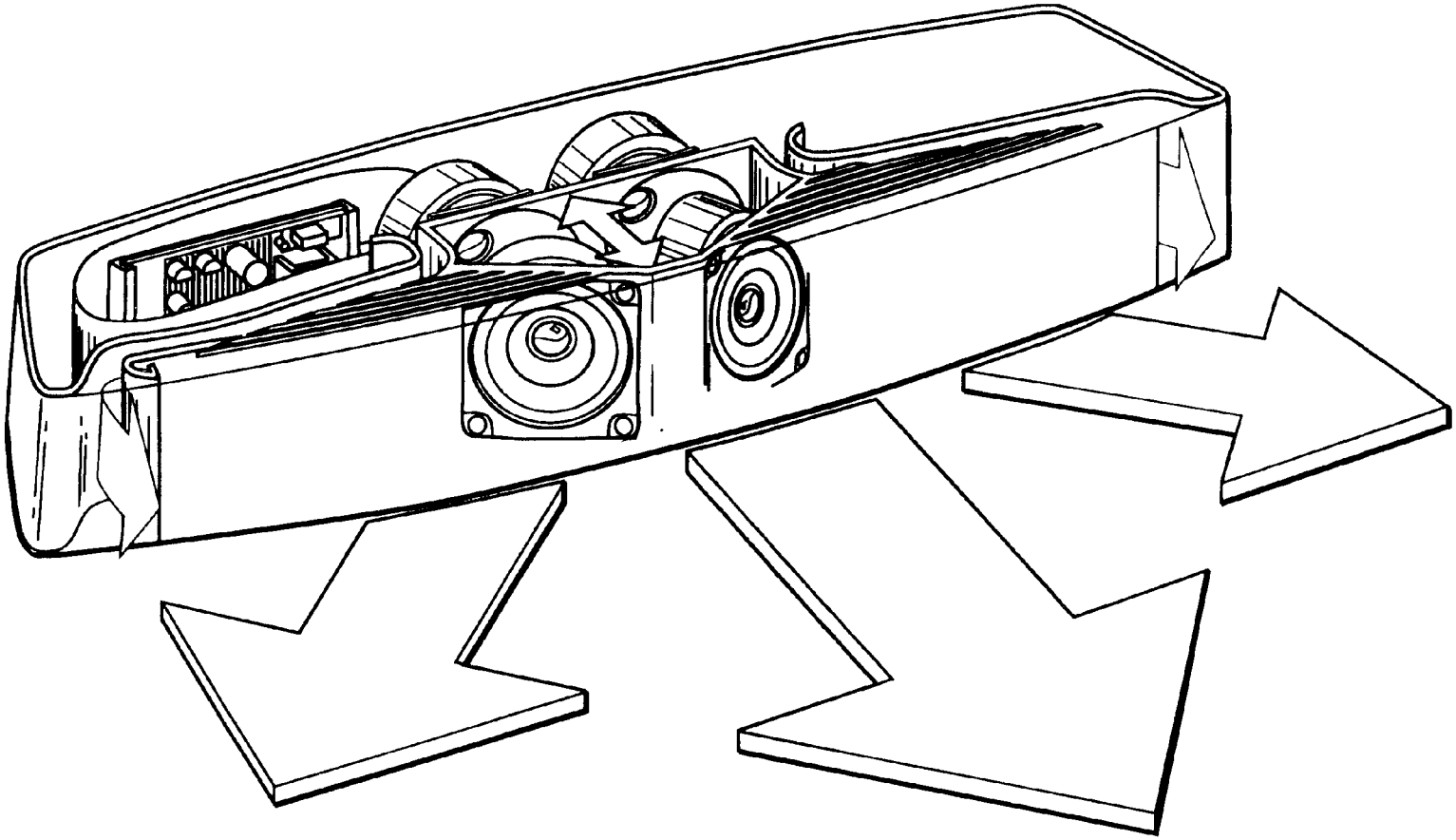

FIGS. 3*a* and 3*b* are combined block diagrams and diagrammatic views partially in section of another electroacoustical transducing system according to the invention;

FIG. 4 is a combined block diagram and diagrammatic view partially in section of another electroacoustical transducing system according to the invention; and FIG. 5 is a pictorial partially cutaway perspective view of another embodiment of the invention with multiple ported drivers.

Similar reference symbols identify corresponding elements throughout the drawings.

Figure 1:
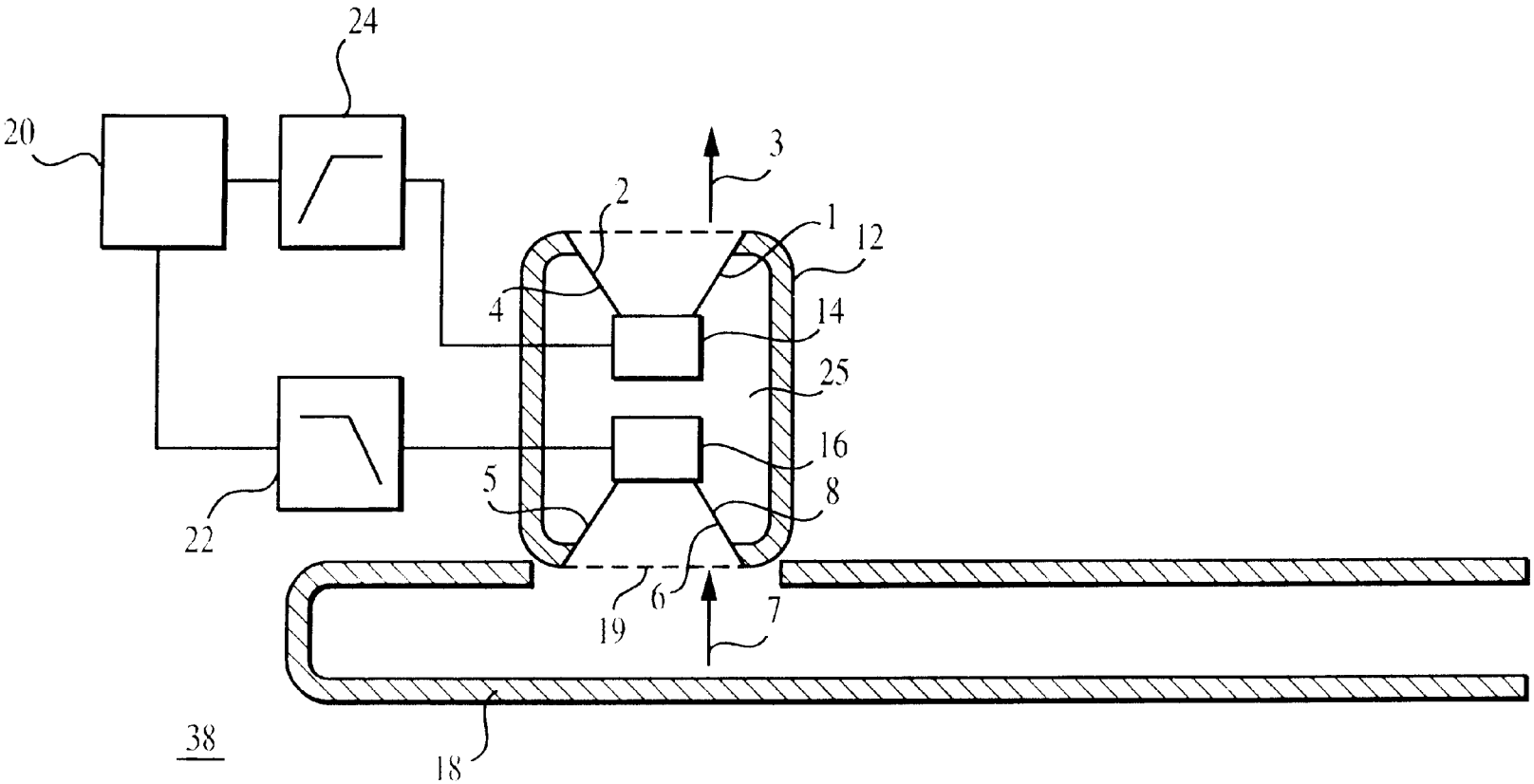
FIG. 1 is a combined block diagram and diagrammatic view partially in section of an electroacoustical transducing system according to the invention.

Referring to the drawings and more particularly to FIG. 1, there is shown an electroacoustical transducing system 38 according to the invention. A housing 12 with enclosure 25 supports first loudspeaker driver 14 and second loudspeaker driver 16 having cones 1, 5, respectively. First loudspeaker driver 14 has a cone 1 with outside and inside surfaces 2 and 4, respectively. An optional high-pass filter 24 couples audio signal input terminal 20 to first loudspeaker driver 14.

Second loudspeaker driver 16 has a cone 5 with outside and inside surfaces 6 and 8, respectively. Outside surface 6 faces acoustic waveguide 18 intermediate the waveguide closed and open ends. A low-pass filter 22 couples audio signal input terminal 20 to second loudspeaker driver 16. First loudspeaker driver 14 and second loudspeaker driver 16 operate over a common range of frequencies where the wavelength is significantly larger than a linear dimension, such as height, width or length of enclosure 25 so that the compliance of enclosure 25 is very low.

First and second loudspeaker drivers 14, 16 may be identical, or second loudspeaker 16 may be a woofer for operating over the bass frequency range. Second loudspeaker driver 16 may be mounted in an opening in waveguide 18 such that the distance to the open end is about twice the distance to the closed end, or at some other location, such as at the closed end. Waveguide 18 may be replaced by a different acoustic impedance, such as an unported, singly ported or multiply ported volume, or an acoustic waveguide open at both ends. Waveguide 18 may be straight with parallel walls as shown or may assume a variety of different configurations, such as folded, tapered at the closed end, tapered along a portion of its length or along substantially its entire length.

First and second loudspeaker drivers 14, 16 are constructed and arranged so that in the common frequency range over which they operate, at least at low audio frequencies, they operate in push-pull to maintain substantially constant pressure in enclosure 25 in this common frequency range. The common frequency range may extend over the full audio frequency range.

In an exemplary embodiment, first loudspeaker driver 14 radiates sound energy directly into the listening region at least including the common frequency range and the audio frequency range above the common frequency range when the common frequency range is less than the full audio frequency range while second loudspeaker driver 16 radiates low frequency energy through the open end of waveguide 18 dimensioned to efficiently transfer low frequency energy from second loudspeaker driver 16 to the listening region outside the enclosure, incorporating the principles of the waveguide speaker disclosed in U.S. Pat. No. 4,628,528 incorporated by reference herein.

This embodiment of the invention furnishes efficient operation over substantially the full range of audio frequencies. At bass frequencies, for example, below 100 Hz, typically in the common frequency range, requiring substantial air movement to produce loud sound levels, first and second loudspeaker drivers 14 and 16 operating push-pull to maintain the pressure in enclosure 15 substantially constant, helping to thereby overcome the low compliance (or high resistance) of the relatively small volume in enclosure 25. Acoustic waveguide 18 further enhances the efficiency of energy transfer between second loudspeaker driver 16 and the listening region outside the enclosure. At higher audio frequencies, first loudspeaker driver 14 radiates the sound energy, thereby using less power than if both first and second loudspeaker drivers 14 and 16 were radiating.

The parameters of optional high-pass filter 24 may be set to balance the power drawn by first and second loudspeaker driver 14 and 16 so that they may be driven by power amplifiers of substantially similar capacity or by a single amplifier through suitable crossover networks. It may also be desirable to protect the loudspeaker drivers from low frequency, high amplitude noise, such as by including a filter with a sharp cutoff below a predetermined low audio frequency. In embodiments without power balancing or protection from low frequency, high amplitude noise, optional high-pass filter 24 may be omitted.

If second loudspeaker driver 16 is a woofer with high frequency roll-off, low-pass filter 22 may be omitted in applications without power balancing.

It may be advantageous to use a full-range driver for first loudspeaker driver 14 and a bass driver or woofer for second loudspeaker driver 16.

Figure 2:
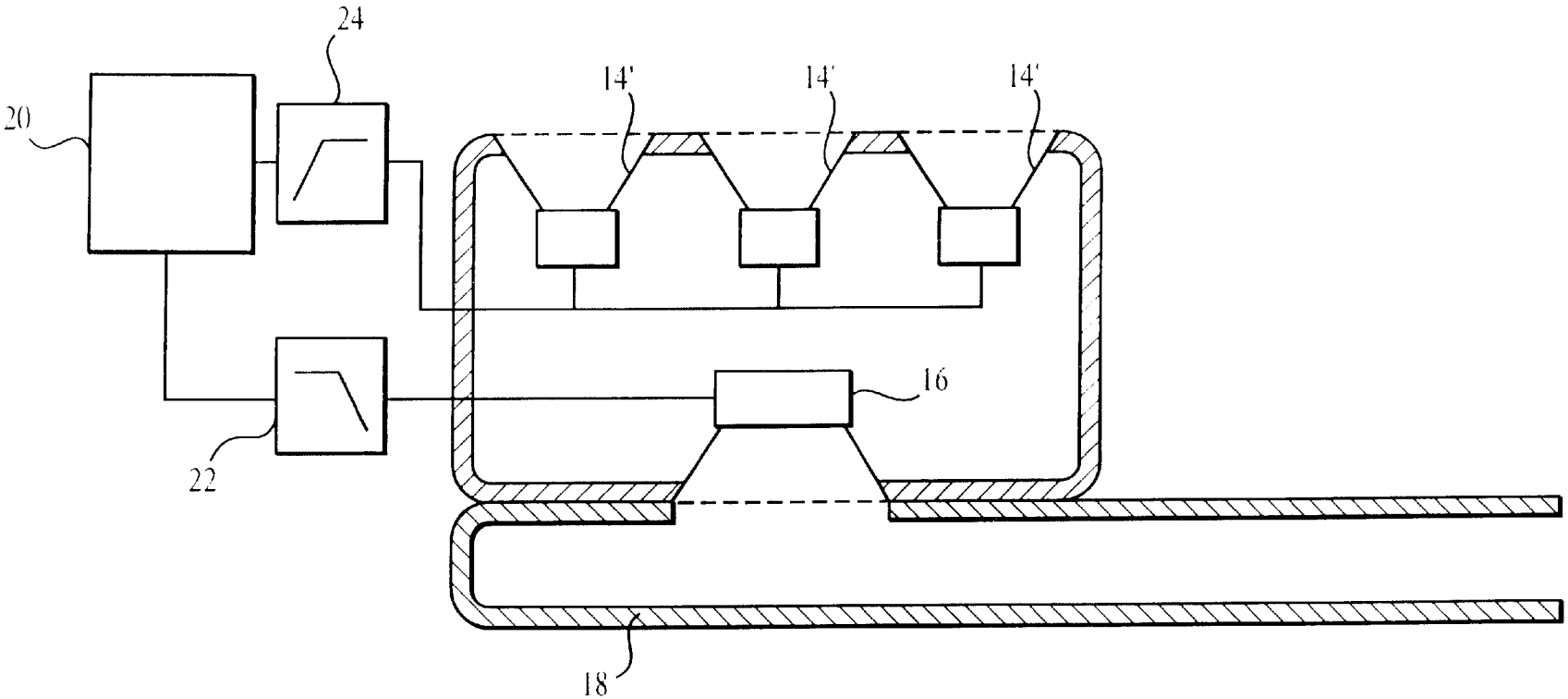
FIG. 2 is a combined block diagram and diagrammatic view partially in section of another electroacoustical transducing system according to the invention.

Referring to FIG. 2, there is shown a second embodiment of the invention having three loudspeaker drivers 14' corresponding to first loudspeaker driver 14 in the system of FIG. 1. Loudspeaker drivers 14' may be identical and have a combined cone area approximately equal to that of second loudspeaker driver 16. Loudspeaker drivers 14' may be arranged to form an array creating a desired sound field pattern. This embodiment has a number of advantages because the smaller drivers 14' coact with the second loudspeaker driver 16 at bass frequencies to provide considerable radiating area, and at higher frequencies operate more efficiently with less mass.

Referring to FIG. 3*a,* there is shown another embodiment of the invention having the three loudspeaker drivers 14L, 14C and 14R corresponding to first loudspeaker driver 14 in FIG. 1 separately so that each can receive a different signal, such as left, center and right channel signals, respectively, of a stereo or surround signal.

Referring to FIG. 3*b,* there is shown a modification of the embodiment of FIG. 3*a.* In this embodiment, power amplifiers 23 couple the signals from audio signal input terminal 22 to the respective loudspeaker drivers 14L, 14C and 14R. Summer 29, low-pass filter 22 and amplifier 27 also couple the audio channels to second loudspeaker driver 16.

Referring to FIG. 4, there is shown still another embodiment of this invention omitting the optional low-pass and high-pass filters 22 and 24 of FIGS. 1, 2, 3*a* and 3*b.* Audio signal input terminal 20' may provide amplified audio signals to loudspeaker drivers 14*a,* 14*b,* 14*c,* 14*d* and 14*e.* Front loudspeaker driver 14*a,* 14*b* and 14*c* each have inside and outside cone surfaces 4' and 2'. Transducers 14*a,* 14*b* and 14*c* may face in different directions to provide a desired sound field pattern. Rear transducers 14*d* and 14*e* each have inside and outside surfaces 6' and 8', respectively, for radiating into acoustic enclosure 18', which includes subchamber 30 and a port 32. Transducers 14*a,* 14*b,* 14*c,* 14*d,* and 14*e* may be selected such that the combined radiating surfaces of the drivers (in this embodiment 14*a,* 14*b* and 14*c*) radiate sound directly into the listening region have a combined area approximately equal to the combined radiating surfaces of transducer 14*d* and 14*e* that radiate to the listening region outside the enclosure through subchamber 30 and port 32. Alternatively, port 32 may be covered by cover 32' (shown in broken lines) so that subchamber 30 is a closed volume that is an impedance coupled to transducers 14*d* and 14*e*.

Referring to FIG. 5, there is shown a pictorial partially cutaway perspective view of another embodiment of the invention in which front loudspeaker drivers 14' and rear loudspeaker drivers 16' are ported through ports 32' and 32" and each operate over substantially the full audio frequency range.

Other embodiments are within the claims.

What is claimed is:

1. A loudspeaker system comprising, a first loudspeaker driver assembly, a second loudspeaker driver assembly, an enclosure supporting said first and second loudspeaker driver assemblies and having an internal volume, at least said first loudspeaker driver assembly constructed and arranged to radiate sound energy directly into the listening region outside said enclosure over substantially the full range of audio frequencies, an acoustic impedance coupling at least said second loudspeaker driver assembly to the listening region outside said enclosure to radiate sound energy over a first predetermined range of audio frequencies embracing a bass portion of said full range of audio frequencies, said first loudspeaker driver assembly, said second loudspeaker driver assembly and said enclosure constructed and arranged to coact to maintain the pressure in said enclosure substantially constant over said bass portion.

2. A loudspeaker system in accordance with claim 1 and further comprising, an audio signal input and a low-pass filter coupling said audio signal input to said second loudspeaker driver assembly.

3. A loudspeaker system in accordance with claim 1 and further comprising, an audio signal input and a high-pass filter coupling said audio signal input to said first loudspeaker driver assembly.

4. A loudspeaker system in accordance with claim 1 wherein said acoustic impedance comprises an acoustic waveguide with ends having at least one end open.

5. A loudspeaker system in accordance with claim 4 wherein the other of the ends of said waveguide is closed.

6. A loudspeaker system in accordance with claim 5 wherein said second loudspeaker driver assembly is mounted in an opening of said acoustic waveguide such that the distance between said opening and the open end is approximately twice the distance between said opening and said closed end.

7. A loudspeaker system in accordance with claim 1 wherein said first loudspeaker driver assembly comprises a plurality of loudspeaker drivers.

8. A loudspeaker system in accordance with claim 7 and further comprising, an audio signal input including a plurality of input channels coupled to respective ones of said loudspeaker drivers.

9. A loudspeaker system in accordance with claim 8 and further comprising, a summer coupling said input channels to said second loudspeaker driver assembly.

10. A loudspeaker system in accordance with claim 1 wherein said acoustic impedance comprises a ported volume.

11. A loudspeaker system in accordance with claim 1 wherein said first loudspeaker driver assembly and said second loudspeaker driver assembly are constructed and arranged to radiate sound energy directly into the listening region outside said enclosure over substantially the full range of audio frequencies.

12. A loudspeaker system in accordance with claim 11 wherein said enclosure includes first and second ports coupling said first and second loudspeaker driver assemblies to the listening region outside said enclosure.

13. A loudspeaker system comprising, a first loudspeaker driver assembly, a second loudspeaker driver assembly, an enclosure supporting said first and second loudspeaker driver assemblies and having an internal volume, at least said first loudspeaker driver assembly constructed and arranged to radiate sound energy into the listening region outside said enclosure over at least the range of audio frequencies above a predetermined first frequency and a predetermined second frequency higher than said first frequency, said second loudspeaker driver assembly constructed and arranged to radiate sound energy over a first predetermined range of audio frequencies embracing at least the range of audio frequencies between said first frequency and said second frequency, said first loudspeaker driver assembly, said second loudspeaker driver assembly and said enclosure constructed and arranged to coact to maintain the pressure in said enclosure substantially constant over at least the range of frequencies between said first and second frequencies.

14. A loudspeaker system in accordance with claim 13 wherein said first predetermined range of audio frequencies is substantially the full audio frequency range.

15. A loudspeaker system in accordance with claim 13 wherein said first predetermined range of audio frequencies corresponds substantially to the bass frequency range.

16. A loudspeaker system in accordance with claim 13 and further comprising, an audio signal input and a low-pass filter coupling said audio signal input to said second loudspeaker driver assembly.

17. A loudspeaker system in accordance with claim 13 and further comprising, an audio signal input and a high-pass filter coupling said audio signal input to said first loudspeaker driver assembly.

18. A loudspeaker system in accordance with claim 13 wherein said first loudspeaker driver assembly comprises a plurality of loudspeaker drivers.

19. A loudspeaker system in accordance with claim 18 and further comprising, an audio signal input including a plurality of input channels coupled to respective ones of said loudspeaker drivers.

20. A loudspeaker system in accordance with claim 19 and further comprising, a summer coupling said input channels to said second loudspeaker driver assembly.

21. A loudspeaker system in accordance with claim 13 wherein said first loudspeaker driver assembly and said second loudspeaker driver assembly are constructed and arranged to radiate sound energy into the listening region outside said enclosure over substantially the full range of audio frequencies.

22. A loudspeaker system in accordance with claim 21 wherein said enclosure includes port structure coupling said first and second loudspeaker driver assemblies to the listening region outside said enclosure.

23. A loudspeaker system comprising, a first loudspeaker driver assembly, a second loudspeaker driver assembly operative over a first predetermined range of audio frequencies embracing a bass portion of the full range of audio frequencies, an enclosure supporting said first and second loudspeaker driver assemblies and having an internal volume, at least said first loudspeaker driver assembly constructed and arranged to radiate sound energy directly into the listening region outside said enclosure over substantially the full range of audio frequencies, an acoustic impedance coupled to said second loudspeaker driver assembly and separated from said internal volume by said second loudspeaker driver assembly and formed with an opening for radiating sound energy into the listening region outside said enclosure over said bass portion, said first loudspeaker driver assembly, said second loudspeaker driver assembly and said enclosure constructed and arranged to coact to maintain the pressure in said enclosure substantially constant over said bass portion.

24. A loudspeaker assembly comprising, a first loudspeaker driver assembly, a second loudspeaker driver assembly, an enclosure supporting said first and second loudspeaker driver assemblies and having an internal volume, said first loudspeaker driver assembly having a different number of loudspeaker drivers than said second loudspeaker driver assembly, said first loudspeaker driver assembly, said second loudspeaker driver assembly and said enclosure constructed and arranged to coact to maintain the pressure in said enclosure substantially constant over the bass frequency range.

* * * * *